US005152445A

United States Patent [19]

Furutsu

[11] Patent Number: 5,152,445

[45] Date of Patent: Oct. 6, 1992

[54] FASTENER GROUP FEEDING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 675,009

[22] Filed: Mar. 26, 1991

[30] Foreign Application Priority Data

Apr. 10, 1990 [JP] Japan ..... 2-37694[U]

[51] Int. Cl.[5] ..... B25C 1/00

[52] U.S. Cl. ..... 227/67; 74/578; 74/128

[58] Field of Search ..... 227/67, 68, 71, 73, 227/74, 136, 137, 138; 74/578, 128

[56] References Cited

U.S. PATENT DOCUMENTS 3,924.788 12/1975 Furutu ..... 227/67
4,610,384 9/1986 Duchin ..... 227/67
4,664,306 5/1987 Levy ..... 227/67

*Primary Examiner*—Douglas D. Watts
*Assistant Examiner*—Allan M. Schrock
*Attorney, Agent, or Firm*—Blum Kaplan

[57] ABSTRACT

A fastener group device includes a feeding gear for meshing with connecting elements of a fastener group, a feeding pawl for intermittent rotation of the feeding gear, a stopper for preventing reverse rotation of the feeding gear and a feeding cam for raising and lowering the feeding pawl. The feeding pawl includes a ratchet and spring, the spring for biasing the ratchet toward the feeding gear. An escape space into which the spring enters following rotation of the feeding gear is provided rearwardly of the feeding pawl. When the spring is received by the escape space, the spring is substantially inoperable for biasing the ratchet toward the feeding gear.

36 Claims, 3 Drawing Sheets

FASTENER GROUP FEEDING DEVICE

BACKGROUND OF THE INVENTION

The present invention relates to improvements to a fastener group feeding device.

Fasteners made of synthetic resin are typically used for connecting tags to articles of merchandise. Quantities, prices and the like regarding the article of merchandise are generally printed on the tags. Each fastener includes a head, a filament and a bar. Fasteners are manufactured in groups, each group connected to a connecting rod through connecting elements joining the central portions of the filament bars to the connecting rod. A plurality of fasteners are therefore formed as one integral group of fasteners which can vary in size and length of filament. Variations in size and length are based on and accommodate different types of articles of merchandise.

Devices for separating each fastener from a group of fasteners and connecting the separated fastener to a tag, article of merchandise, etc. are well known in the art (i.e., fastener group feeding device). For changing of a fastener group, it is necessary to draw out the remaining fasteners of the group from the fastener group feeding device. If the fastener group in being drawn out is pulled out by force, the connecting elements of the fasteners can be squeezed by a feeding gear of the device. Deformation of the fastener group connecting elements can result. Frequently, the deformed fastener group connecting elements cannot mesh with the feeding gear of the device when the group is used thereafter.

Temporary disengagement of the feeding gear when the fastener group is changed can be provided through a feeding pawl. The pawl rotatingly engages and disengages the feeding gear and is typically biased towards the feeding gear through use of a spring. The feeding pawl, however, can be damaged when the fastener group is forcibly removed by pulling on the latter.

Almost all components of a typical feeding device including, but not limited to, the feeding pawl are formed of a synthetic resin. Maintaining a constant spring force sufficient for biasing the feeding pawl toward the feeding gear is difficult especially when using a fastener group feeding device formed of synthetic resin.

It is therefore desirable to provide a fastener group feeding device which permits simple, easy and fast removal of a fastener group from the device without deforming the fastener group or feeding device. It is also desirable to provide a fastener group feeding device which minimizes weakening of the spring force applied to the feeding pawl in biasing the latter.

SUMMARY OF THE INVENTION

Generally speaking, in accordance with the invention, a fastener group feeding device includes a feeding gear and feeding pawl for rotating the feeding gear and including a ratchet and spring. The spring biases the ratchet toward the feeding gear. The device also includes an escape area for receiving the spring following rotation of the feeding gear. The spring when received within the escape area is substantially inoperable for biasing the ratchet toward the feeding gear. Consequently, the device minimizes weakening of the spring force applied to the ratchet in biasing the latter when removing a fastener group from the device without deforming the fastener group or feeding device.

The device further includes a presser guide for controlling the spring. The feeding pawl is positioned between the feeding gear and the presser guide. The spring is in sliding engagement with the presser guide. The presser guide is positioned below the escape area.

The device also includes a baffle guide for guiding the ratchet away from engagement with the feeding gear following rotation of the latter. A feeding cam moves the feeding pawl toward and away from the baffle guide.

The device further includes a stopper for preventing the feeding gear from rotating in one of two directions. The stopper includes a pivot portion for pivotable engagement of the stopper with the feeding gear and for disengagement of the stopper from the feeding gear. The stopper further includes a spring responsive to the pivot portion for biasing the stopper toward the feeding gear.

The feeding pawl is operable for intermittently rotating the feeding gear. The ratchet is positioned between the feeding gear and spring. The ratchet and spring each have a distal end. A widening gap between the ratchet and spring exists with the gap widening in approaching the distal ends of the ratchet and spring.

Accordingly, it is an object of the invention to provide an improved fastener group feeding device which permits simple, easy and fast removal of a fastener group from the device without deforming the fastener group or feeding device.

It is another object of the invention to provide an improved fastener group feeding device which minimizes weakening the spring force applied to a feeding pawl in biasing the latter.

Still other objects and advantages of the invention will, in part, be obvious and will, in part, be apparent from the specification.

The invention accordingly comprises an article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings in which.

DETAILED DESCRIPTION OF THE PREFERRED EMBODIMENT

To facilitate description of the invention, an overview of a fastener group feeding device 100 followed by a more detailed discussion regarding construction and operation will now follow.

Figure 1:
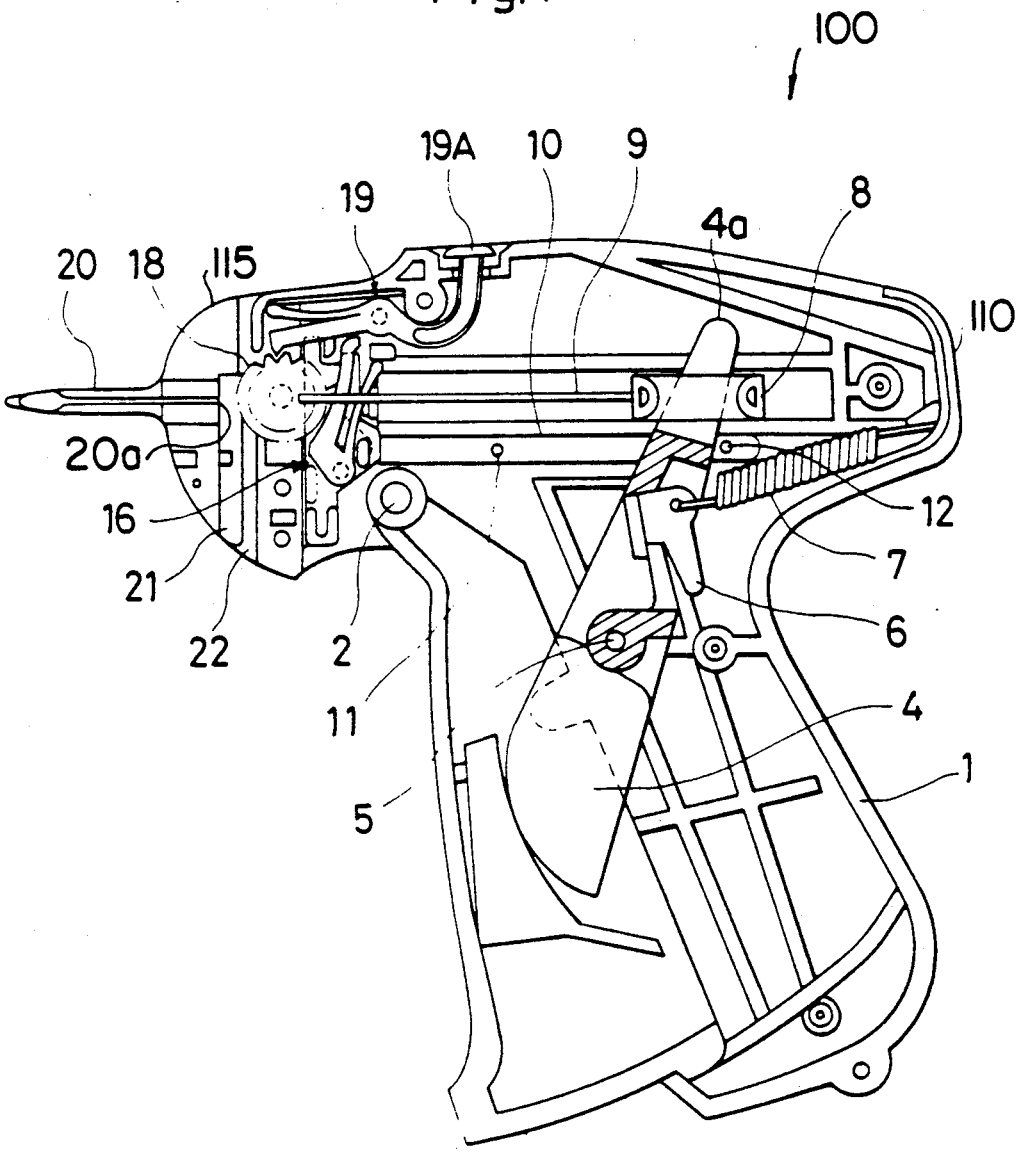
FIG. 1 is a side elevational view illustrating the internal structure of a fastener group feeding device in accordance with the invention.

As shown in FIG. 1, device 100 includes a trigger 3 rotating around a first pin 2. A lever 4 having a head 4*a* rotates in the longitudinal direction of a main body 1 by operation of trigger 3. A second pin 5 serves as the fulcrum for lever 4. Lever 4 is operable for clockwise rotation by a return spring 7 which extends between a guide 6 and a rear end 110 of main body 1. Guide 6 is slidably connected to lever 4.

A first operating piece 8 is connected to a pushing rod 9. Head 4*a* of lever 4 is coupled to first operating piece 8 such that operating piece 8 moves in a forward direction (i.e., to the left as shown in FIG. 1) and backwardly (i.e., to the right as shown in FIG. 1) based on the rotatable position of lever 4. A second operating piece 10 is positioned below first operating piece 8. Second operating piece 10 is also coupled to lever 4 so as to move in conjunction with first operating piece 8 based on the rotatable position of lever 4.

Second operating piece 10 includes a first projection 11 and a second projection 12 near the front and back of lever 4, respectively. A third projection 13 is provided at the front end of second operating piece 10, as shown in FIG. 2.

Beyond first operating piece 8 and second operating piece 10 in a front portion 115 of main body 1 is a hollow needle 20. Hollow needle 20, which has an inlet 20*a*, is positioned on the center line (i.e., along the major axes) of pushing rod 9. Along inlet 20*a* of hollow needle 20 is a guide groove 22 into which a fastener group (not shown) is slidably inserted. A feeding gear 18 is positioned so as to face guide groove 22. A cut blade 21 is disposed facing the front edge of guide groove 22.

Figure 2:
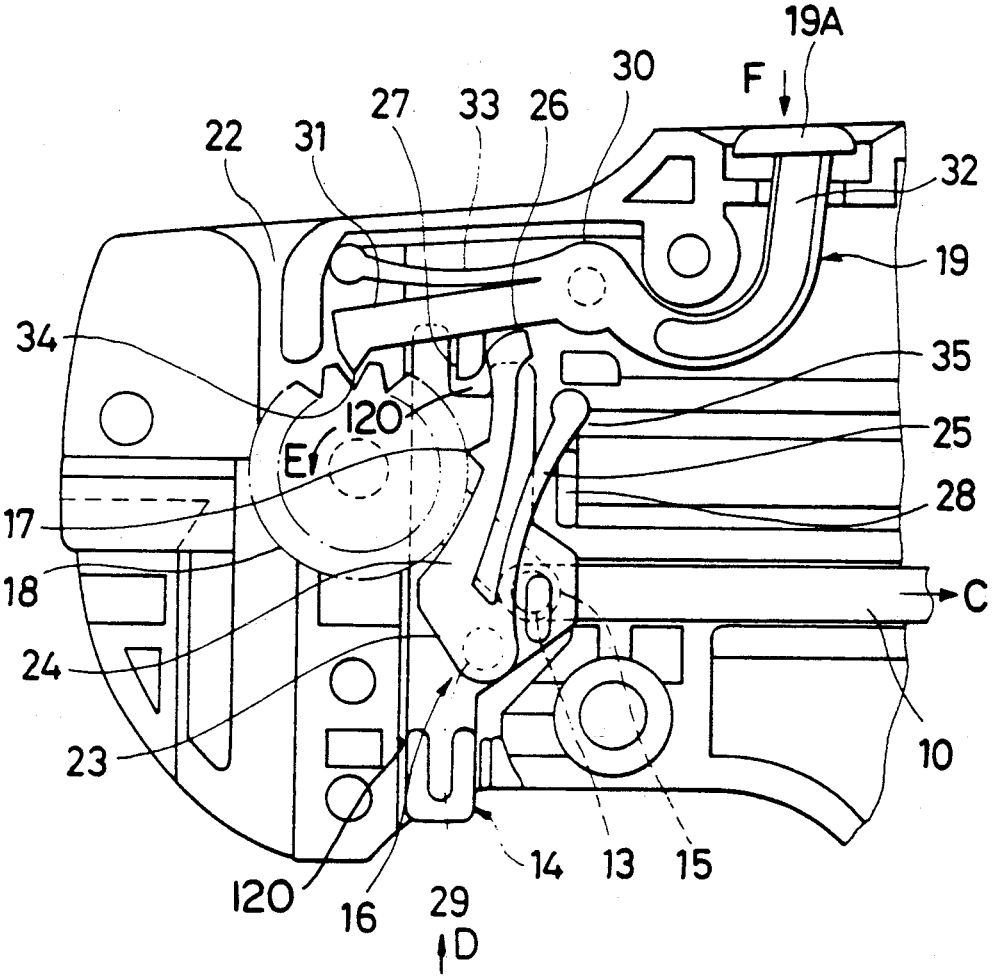
FIG. 2 is a fragmented side elevational view of the fastener group feeding device.

As shown in FIG. 2, a feeding cam 14, which is slidably seated within a channel 120, is positioned adjacent to feeding gear 18. Feeding cam 14, which includes a cam groove 15, can move upwardly (i.e., freely elevated) from the position shown in FIG. 2. Third projection 13 is positioned and operable for slidable movement within cam groove 15. Cam groove 15 is positioned on the back (i.e., reverse side of feeding cam 14) and inclined downwardly to the right as shown in FIG. 2.

Figure 3:
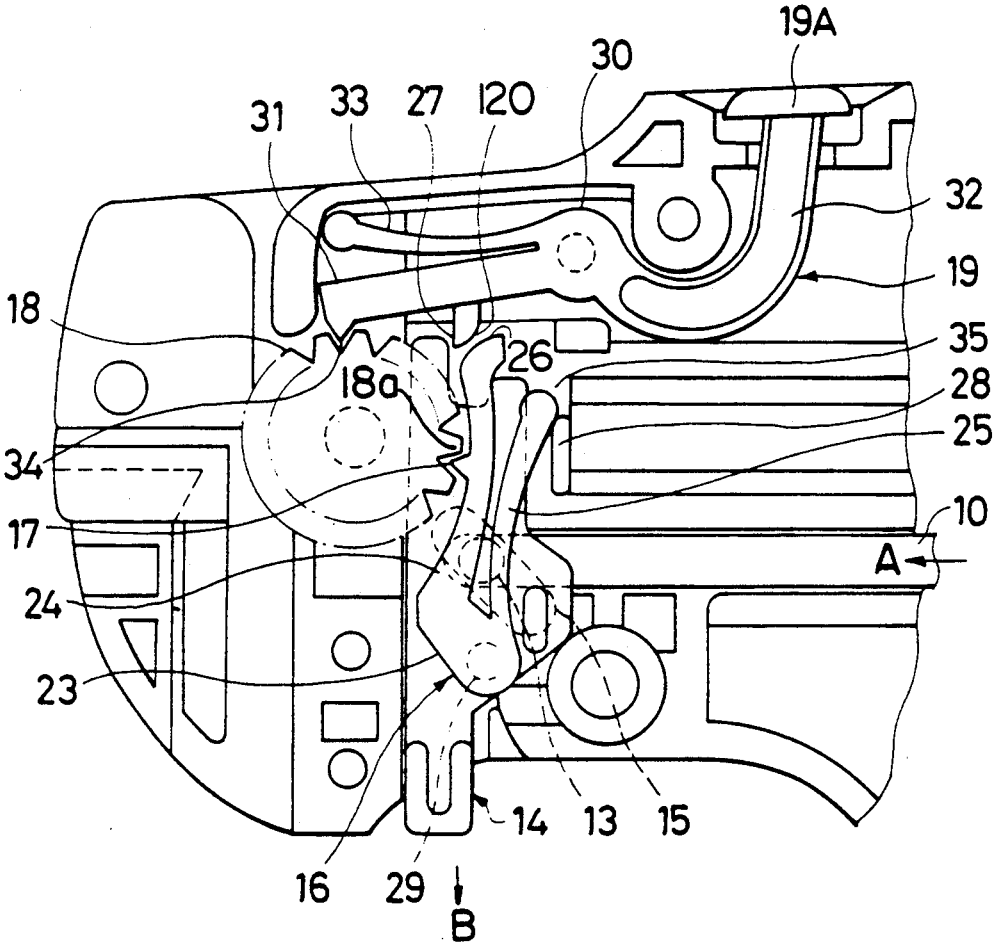
FIG. 3 is a fragmented side elevational view of the fastener group feeding device, similar to FIG. 2, during operation of the device.

As shown in FIG. 3, when second operating piece 10 moves in a forwardly direction (i.e., as denoted by an arrow A) projection 13 travels along and within cam groove 13 in an upwardly direction to the left. Consequently, feeding cam 14 travels downwardly in a direction denoted by an arrow B. As shown in FIG. 2, when operating piece 10 moves in a reverse (i.e., backwardly) direction (as denoted by an arrow C), projection 13 travels along and within cam groove 13 in a downwardly direction to the right. Consequently, feeding cam 14 travels upwardly in a direction denoted by an arrow D.

A feeding pawl 16, which includes a crank 23, a ratchet 24 and a spring 25, is axially supported through a shaft 29 by feeding cam 14. Through rotation of shaft 29 in clockwise and counterclockwise directions, feeding pawl 16 can pivot away from and towards feeding gear 18 as shown in FIGS. 2 and 3, respectively. Ratchet 24 and spring 25 are integrally connected to the front and rear ends of crank 23, respectively. The spacing between ratchet 24 and spring 25 widens as the distance between ratchet 24 and spring 25 from crank 23 increases. Ratchet 24 includes a pawl 17 for engagement between a plurality of teeth 18*a* of feeding gear 18. Pawl 17 is positioned substantially intermediate along the substantially convex outer periphery of ratchet 24. As shown in FIG. 2, based on feeding cam 14 travelling in an upwardly direction denoted by arrow D, pawl 17 engages teeth 18*a* so as to intermittently rotate feeding gear 18 in a counterclockwise direction denoted by an arrow E. Main body 1 also includes a baffle guide 27 positioned near the upper end of the path traveled by a head part 26 of ratchet 24.

As shown in FIG. 2, when operating piece 10 moves in the direction denoted by arrow C, feeding cam 14 moves upwardly in the direction of arrow D such that head part 26 slides against and to the right of baffle guide 27. Prior to head part 26 coming into contact with baffle guide 27, pawl 17 through engagement with teeth 18*a* of feeding gear 18 causes feeding gear 18 to rotate in a counterclockwise direction as denoted by arrow E. As head part 26 of ratchet 24 comes into contact with and begins to slide along baffle guide 27, pawl 17 disengages from feeding gear 18.

Main body 1 also includes a pressure guide 28 positioned behind feeding pawl 16 for pressing against spring 25 as feeding cam 14 moves upwardly in the direction of arrow D. Through the integral connection between spring 25, crank 23 and ratchet 24, as feeding cam 14 moves upwardly in the direction of arrow B, spring 25 biases pawl 17 of ratchet 24 toward and thereby engaging feeding gear 18. An escape space 35 of main body 1 positioned above pressure guide 28 receives spring 25 of feeding pawl 16 as spring 25 travels beyond pressure guide 28. When spring 25 is received within escape space 35, the spring (biasing) force of spring 25 is substantially no longer applied to ratchet 24. Consequently, device 100 minimizes weakening of the spring force applied to ratchet 24 in biasing the latter.

As shown in FIGS. 2 and 3, a stopper 19 is formed of a straight arm 31, a substantially J-shaped arm 32 and a presser spring 33 radiating from a boss 30. A pawl 34, located at the distal end of arm 31, meshes with feeding gear 18 so as to prevent rotation of feeding gear 18 in a direction opposite to the direction of arrow E.

After the above-mentioned components are assembled in main body 1, a mating main body part (not shown) having substantially the same external shape as main body 1 is joined to the latter using connectors such as screws. The fastener group feeding device 100 is preferably formed of a synthetic resin except for pins 2 and 5, return spring 7, pushing rod 9, hollow needle 20, cutting blade 21 and the screws.

Fastener group feeding device 100 operates as follows. As shown in FIG. 1, first and second operating pieces 8 and 10 are normally biased toward rear end 110 of main body 1 by return spring 7. As shown in FIG. 2, feeding cam 14, which third projection 13 of second operating piece 10 is in engagement with, is positioned at its highest point (uppermost position) of travel. Feeding pawl 16 has been rotated clockwise through head part 26 sliding against baffle guide 27. Pawl 17 of ratchet 24 is released from and no longer in engagement with feeding gear 18. Spring 25 of feeding pawl 16 is positioned in escape space 35, that is, above and substantially free from pressure being exerted by pressure guide 28.

When trigger 3 is squeezed after a fastener group (not shown) is set in guide groove 22, lever 4 rotates in a counterclockwise direction. First operating piece 8 and second operating piece 10 now advance toward front portion 115 of main body 1. A bar of a fastener (not shown) is pushed along and out of hollow needle 20 by pushing rod 9 which is connected to first operating piece 8. Simultaneously, as shown in FIG. 3, feeding cam 14 moves downwardly in a direction denoted by arrow B with the advance of second operating piece 10 in the direction of arrow A. Feeding pawl 16 is drawn into the space between feeding gear 18 and pressing guide 28. Ratchet 24 is urged toward feeding gear 18 by spring 25 of feeding pawl 16. Engagement of pawl 17 of ratchet 24 with feeding gear 18 results.

By now reducing the pressure exerted on trigger 3, lever 4 rotates in a clockwise direction through coupling of the latter to return spring 7. First operating piece 8 and second operating piece 10 move toward rear end 110 of main body 1.

Feeding pawl 16, as shown in FIG. 2, is now pushed upwardly by feeding cam 14 in a direction denoted by arrow D. Feeding gear 18 rotates in counterclockwise direction E through contact with pawl 17 of racket 24. The fastener group (not shown) is therefore fed downwardly along guide groove 22. As feeding cam 14 continues to rise, head part 26 of ratchet 24 comes into contact with baffle guide 27, as shown in FIG. 2, such that feeding pawl 16 rotates in a clockwise direction. As a result, pawl 17 of ratchet 24 moves away (i.e., disengages) from feeding gear 18. As feeding pawl 16 rotates in a clockwise direction through head part 26 sliding against baffle guide 27, head part 26 of spring 25 of feeding pawl 16 retracts into escape space 35 (provided above presser guide 28). Spring 25 is now substantially free from pressure being exerted by presser guide 28.

As also shown in FIG. 2, when a head part 19A of stopper 19 is depressed in a direction indicated by an arrow F, pawl 34 of stopper 19 is pivoted upwardly away from and no longer in contact with feeding gear 18. Feeding gear 18 is now free to rotate. Consequently, the fastener group can be pulled out easily and simply from guide groove 22 without damage to either the fastener group or any element within device 100.

Disengagement of feeding pawl 16 from feeding gear 18 has been described heretofore based on head part 26 sliding against baffle guide 27 with pawl 17 being positioned substantially midway along ratchet 24. It is to be understood, however, that in accordance with an alternative embodiment of the invention feeding pawl 16 also can be automatically released from engagement with feeding gear 18 by pawl 17 of ratchet 24 being positioned closer to head part 26. That is, pawl 17 will travel beyond contact with feeding gear 18 when feeding cam 14 is positioned at its highest point (uppermost position) of travel.

It will thus be seen that the objects set forth above and those made apparent from the preceding description are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

I claim:

1. A fastener group feeding device, comprising:

a feeding gear;

feeding pawl means for rotating said feeding gear and including a ratchet and spring means, said spring means for biasing said ratchet toward said feeding gear; and escape means for receiving said spring means following rotation of said feeding gear;

wherein said spring means when received by said escape means is translated away from said feeding gear rendering said spring means substantially inoperable for biasing said ratchet toward said feeding gear.

2. The fastener group feeding device of claim 1, further including presser guide means for controlling said spring means, said feeding pawl means positioned between said feeding gear and said presser guide means.

3. The fastener group feeding device of claim 2, wherein said spring means is in sliding engagement with said presser guide means.

4. The fastener group feeding device of claim 2, wherein said presser guide means is positioned below said escape means.

5. The fastener group feeding device of claim 3, wherein said presser guide means is positioned below said escape means.

6. The fastener group feeding device of claim 1, further including baffle guide means for guiding said ratchet away from engagement with said feeding gear following rotation of said feeding gear.

7. The fastener group feeding device of claim 6, further including feeding cam means for elevating and lowering said feeding pawl means towards and away from said baffle guide means, respectively.

8. The fastener group feeding device of claim 2, further including baffle guide means for guiding said ratchet away from engagement with said feeding gear following rotation of said feeding gear.

9. The fastener group feeding device of claim 8, further including feeding cam means for elevating and lowering said feeding pawl means towards and away from said baffle guide means, respectively.

10. The fastener group feeding device of claim 3, further including baffle guide means for guiding said ratchet away from engagement with said feeding gear following rotation of said feeding gear.

11. The fastener group feeding device of claim 10, further including feeding cam means for elevating and lowering said feeding pawl means towards and away from said baffle guide means, respectively.

12. The fastener group feeding device of claim 4, further including baffle guide means for guiding said ratchet away from engagement with said feeding gear following rotation of said feeding gear.

13. The fastener group feeding device of claim 12, further including feeding cam means for elevating and lowering said feeding pawl means towards and away from said baffle guide means, respectively.

14. The fastener group feeding device of claim 5, further including baffle guide means for guiding said ratchet away from engagement with said feeding gear following rotation of said feeding gear.

15. The fastener group feeding device of claim 14, further including feeding cam means for elevating and lowering said feeding pawl means towards and away from said baffle guide means, respectively.

16. The fastener group feeding device of claim 1, further including stopper means for preventing said feeding gear from rotating in one of two directions.

17. The fastener group feeding device of claim 2, further including stopper means for preventing said feeding gear from rotating in one of two directions.

18. The fastener group feeding device of claim 3, further including stopper means for preventing said feeding gear from rotating in one of two directions.

19. The fastener group feeding device of claim 6, further including stopper means for preventing said feeding gear from rotating in one of two directions.

20. The fastener group feeding device of claim 7, further including stopper means for preventing said feeding gear from rotating in one of two directions.

21. The fastener group feeding device of claim 11, further including stopper means for preventing said feeding gear from rotating in one of two directions.

22. The fastener group feeding device of claim 16, wherein said stopper means includes pivot means for pivotable engagement of said stopper means with said feeding gear and for pivotable disengagement of said stopper means from said feeding gear.

23. The fastener group feeding device of claim 22, wherein said stopper means further includes bias means responsive to said pivot means for biasing said stopper means toward said feeding gear.

24. The fastener group feeding device of claim 17, wherein said stopper means includes pivot means for pivotable engagement of said stopper means with said feeding gear and for pivotable disengagement of said stopper means from said feeding gear.

25. The fastener group feeding device of claim 24, wherein said stopper means further includes bias means responsive to said pivot means for biasing said stopper means toward said feeding gear.

26. The fastener group feeding device of claim 11, wherein said stopper means includes pivot means for pivotable engagement of said stopper means with said feeding gear and for pivotable disengagement of said stopper means from said feeding gear.

27. The fastener group feeding device of claim 26, wherein said stopper means further includes bias means responsive to said pivot means for biasing said stopper means toward said feeding gear.

28. The fastener group feeding device of claim 1, wherein said feeding pawl means is operable for intermittently rotating said feeding gear.

29. The fastener group feeding device of claim 2, wherein said feeding pawl means is operable for intermittently rotating said feeding gear.

30. The fastener group feeding device of claim 1, wherein said ratchet is positioned between said feeding gear and said spring means.

31. The fastener group feeding device of claim 2, wherein said ratchet is positioned between said feeding gear and said spring means.

32. The fastener group feeding device of claim 11, wherein said ratchet is positioned between said feeding gear and said spring means.

33. The fastener group feeding device of claim 1, wherein said ratchet and spring means each have a distal end and are separated from each other by a gap, said gap widening in approaching the distal ends of said ratchet and spring means.

34. The fastener group feeding device of claim 2, wherein said ratchet and spring means each have a distal end and are separated from each other by a gap, said gap widening in approaching the distal ends of said ratchet and spring means.

35. The fastener group feeding device of claim 6, wherein said ratchet and spring means each have a distal end and are separated from each other by a gap, said gap widening in approaching the distal ends of said ratchet and spring means.

36. The fastener group feeding device of claim 11, wherein said ratchet and spring means each have a distal end and are separated from each other by a gap, said gap widening in approaching the distal ends of said ratchet and spring means.

* * * * *